United States Patent [19]

Kesselman et al.

[11] 4,438,844

[45] Mar. 27, 1984

[54] TRAVELING GARMENT BAG

[76] Inventors: Jacob Kesselman, 53B Troy Dr., Springfield, N.J. 07081; Howard Kesselman, 628 S. Highland, Merian Station, Pa. 19066

[21] Appl. No.: 407,087

[22] Filed: Aug. 11, 1982

[51] Int. Cl.[3] ..... A45C 3/00; A45C 13/26

[52] U.S. Cl. ..... 206/287.1; 206/289; 190/115

[58] Field of Search ..... 190/41 R, 41 B, 41 C, 190/41 Z, 43, 55 R, 55 A, 56, 115; 206/284-291

[56] References Cited

U.S. PATENT DOCUMENTS

| | | | |
|---|---|---|---|
| 262,131 | 8/1882 | Schwerin | 190/56 |
| 1,705,149 | 3/1929 | Brady | 190/43 |
| 2,087,210 | 7/1937 | Marbury et al. | 190/41 Z X |
| 2,154,630 | 4/1939 | Marbury et al. | 190/41 Z X |
| 2,261,291 | 11/1941 | Salavsky | 190/43 |
| 2,606,636 | 8/1952 | Braverman | 190/43 |
| 3,710,901 | 1/1973 | Guard et al. | 190/41 R |
| 4,193,482 | 3/1980 | Koff | 190/41 B |

FOREIGN PATENT DOCUMENTS

| | | | |
|---|---|---|---|
| 675746 | 5/1939 | Fed. Rep. of Germany | 190/41 B |
| 216846 | 1/1942 | Switzerland | 190/41 Z |

*Primary Examiner*—William Price
*Assistant Examiner*—Sue A. Weaver
*Attorney, Agent, or Firm*—Carella, Byrne, Bain & Gilfillan

[57] ABSTRACT

There is disclosed a novel garment bag for hanging items therein comprising a storage area formed by a front panel, a back panel and a side gusset, a means for opening and closing said storage area positioned on the front panel. The garment bag is further comprised of a handle assembly positionable at a terminus of said means for opening and closing the storage area on the side gusset. The handle assembly is comprised of a handle member, a hanging member, a closure member and a means for attaching said handle assembly to said side gusset of said storage area.

11 Claims, 14 Drawing Figures

TRAVELING GARMENT BAG

FIELD OF THE INVENTION

This invention relates to a garment bag, and more particularly to a garment bag that can be adapted for traveling.

BACKGROUND OF THE INVENTION

In this day of extensive business travel for short periods of time, it is very important for the traveler to get off the plane quickly without undue delay, collect his luggage and then proceed to rent a car or take a taxi to a hotel or motel to prepare for a meeting. The problem with this scenario is the delay encountered when one waits for his luggage to be delivered by the carrier.

To overcome any delay, more and more travelers are carrying their luggage onto the plane. This also tends to present problems since any luggage carried onto a plane is restricted as to its size; that is, if it is a piece of luggage it must fit under a seat. The problem arising with luggage this small is if a suit is packed therein, when it is unpacked, it is very wrinkled.

One way to overcome the wrinkling problem is to carry on a garment bag and hang it in areas allowed on the aircraft. The present garment bags an individual can purchase presently present a number of problems to the individual owner. Initially, some garment bags are just zippered bags where one puts their clothes in on hangers. The hangers stick out the top and serve somewhat as a handle and cause a strain on the fingers.

Another type of garment bag has hangers attached to a rack within the bag, but the bag has a shoulder strap and no handles. The problem with this type of bag is that the hangers fall off the rack to the bottom of the bag and thereby wrinkling the clothes. As previously stated, this type of bag is carried on the shoulder and does not have a handle for carrying.

Accordingly, neither type of garment bag presently on the market provides not only a garment bag but in addition a handle with a hanging assembly, a secured area for placing a hanger and the ability to fold the garment bag upon itself and lock it together to prevent theft and carry it like a large attache case.

OBJECTS OF THE INVENTION

An object of the present invention is to provide a novel garment bag.

Another object of the present invention is to provide a novel garment bag that can be adapted for traveling.

Still another object of the present invention is to provide a novel garment bag having a security locking apparatus.

Yet another object of the present invention is to provide a novel garment bag that can be folded and secured upon itself.

Still yet another object of the present invention is to provide a novel garment bag that has a self-contained handle and hanging assembly.

A further object of the present invention is to provide a novel garment bag that does not provide pressure to the garment bag material when clothes are placed therein.

Another object of the present invention is to provide a novel garment bag that can be produced at a reduced cost.

Still yet another object of the present invention is to provide a novel garment bag that can utilize clothes hangers of various shapes and sizes.

SUMMARY OF THE INVENTION

These and other objects of the present invention are achieved by a novel garment bag for hanging items therein comprising a storage area formed by a front panel, a back panel and a side gusset, a means for opening and closing said storage area positioned on the front panel. The garment bag is further comprised of a handle assembly positionable at a terminus of said means for opening and closing the storage area on the side gusset. The handle assembly is comprised of a handle member, a hanging member, a closure member and a means for attaching said handle assembly to said side gusset of said storage area.

BRIEF DESCRIPTION OF THE DRAWING

Other objects and advantages of the present invention will become apparent by reference to the following detailed description of the embodiment thereof when taken in conjunction with the accompanying drawings, in which.

DETAILED DESCRIPTION OF THE INVENTION

Figure 1:
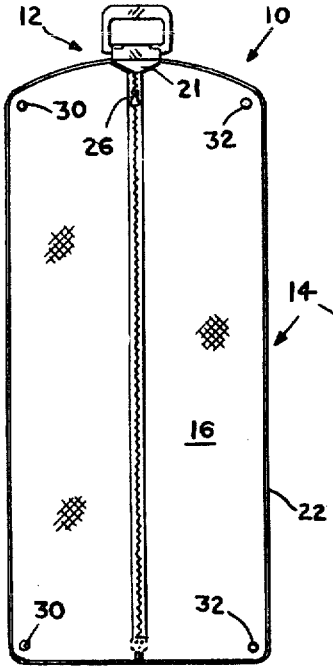
FIG. 1 is a front elevational view of the present invention.
Figure 2:
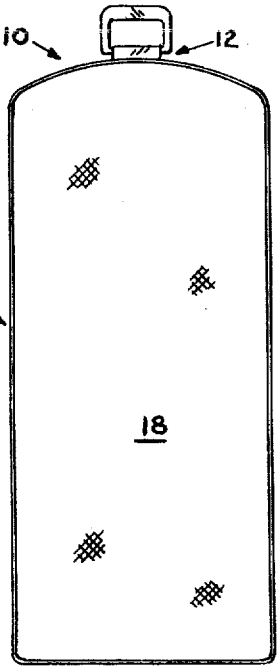
FIG. 2 is a rear elevational view of the present invention.
Figure 2A:
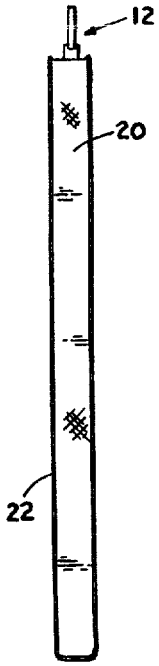
FIG. 2A is a side elevational view of the present invention.
Figure 3:
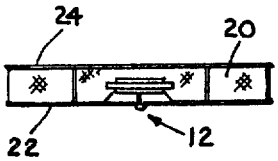
FIG. 3 is a top view of the present invention.
Figure 4:
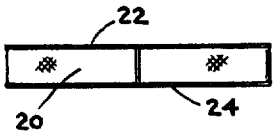
FIG. 4 is a bottom view of the present invention.

Now referring to FIGS. 1, 2, 2A, 3 and 4, there is shown a garment bag, generally indicated as 10. The garment bag is comprised of a handle assembly, generally indicated as 12 and a storage area, generally indicated as 14.

The storage area 14 is formed by a front panel 16, a back panel 18 and a side panel gusset 20. Panels 16, 18 and 20 can be plastic, cloth or other suitable material. The side panel 20 is stitched to both the front panel 16 and rear panel 20 about the perimeter of each panel except for a handle area 21 at the top of front panel 16 through the use of piping, 22 and 24 respectively to form the storage area 14.

Located on the front panel 16 is a zipper 26, extending from the bottom of front panel 16 to the handle area 21. Zipper 26 provides the means for opening storage area 14 to place items therein.

Figure 8:
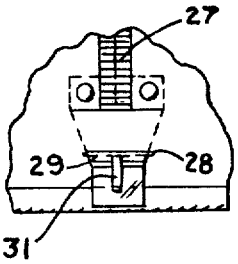
FIG. 8 is a cutaway view of the bottom of the zipper assembly.
Figure 13:
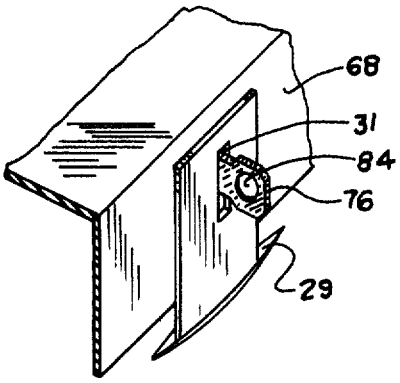
FIG. 13 is a sectional view of the present invention folded upon itself.

Now referring to FIG. 8, there is shown a partial view of the bottom of front panel 16 and an end 27 of zipper 26. As is shown in the drawing, arising inside of storage area 14 and attached thereto and extending out of a slit 28 in front panel 16 is eyeclip or tab 29 having a longitudinal slit 31. The purpose of the eyeclip or tab 29 will be further explained in conjunction with handle assembly 12.

Located on front panel 16 of storage area 14 in opposite corners of front panel 16 are fasteners, 30 and 32 respectively. Fasteners 30 and 32, can be snap fasteners of the ball and socket type, eyehooks, VELCRO fasteners or other suitable fasteners. The purpose of fasteners 30 and 32 is to permit the user of garment bag 10 to fold storage area 14 upon itself for the purpose of making garment bag 10 more compact.

Figure 5:
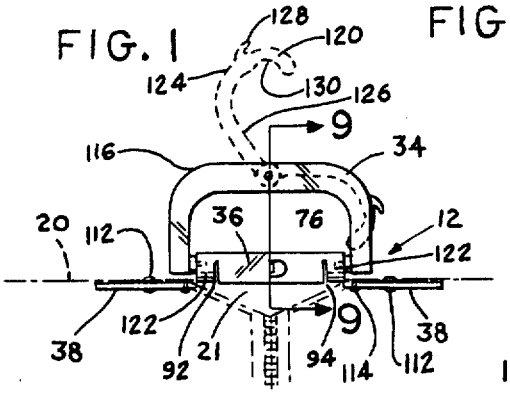
FIG. 5 is a front elevational view of the handle assembly showing the operation of the hook used for hanging the garment bag.
Figure 6:
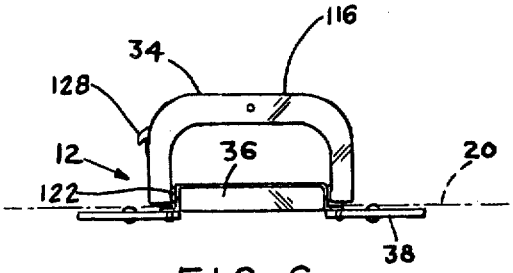
FIG. 6 is a rear elevational view of the handle assembly.
Figure 7:
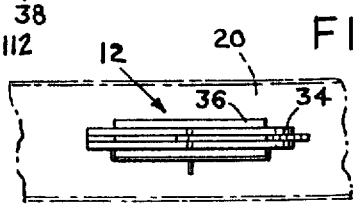
FIG. 7 is a top view of the handle assembly.
Figure 9:
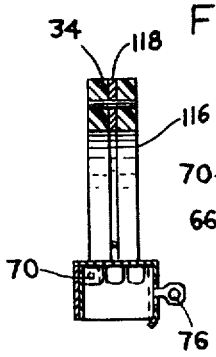
FIG. 9 is a cross-sectional view of the handle assembly taken along the line 9—9 in FIG. 5 looking in the direction of the arrows.

Now referring to FIGS. 5, 6 and 7, there is shown handle assembly 12 comprised of a handle member 34, a closure member 36 and an attachment member 38.

Figure 11:
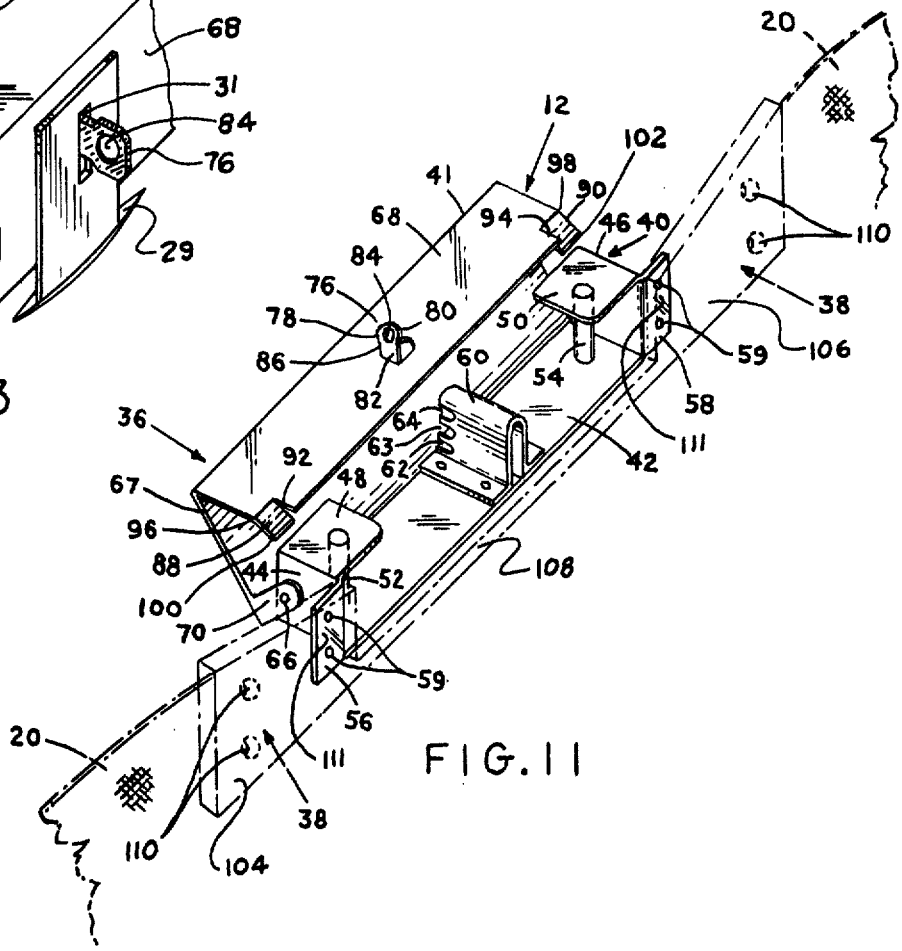
FIG. 11 is a cutaway view of one embodiment of the closure assembly.

Now referring to FIG. 11, there is shown closure member 36 formed of a frame member 40 and a closure lid 41 pivotably positioned on the frame member 40. Frame member 40 is formed by a back wall 42, side walls 44 and 46 respectively, front flanges 48 and 50 respectively, support pins 52 and 54 respectively and end flanges 56 and 58 respectively, positioned perpendicularly to the bottom of side walls 44 and 46, each end flange 56 and 58 having a pair of orifices 59. Support pins 52 and 54 are positioned between front flanges 48 and 50 and back wall 42 to maintain the structural integrity of closure member 36.

Mounted on the inside of back wall 42 and extending outwardly therefrom within closure member 36 is a hangar support 60. Hangar support 60 has three notches, 62, 63 and 64 respectively for positioning hangars having garments mounted thereon.

Figure 10:
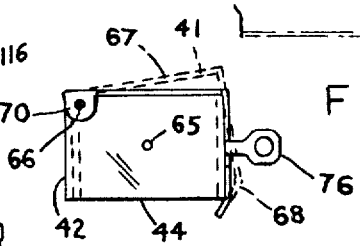
FIG. 10 is a partial side view of the closure assembly.

Referring now to FIG. 10, side wall 44 (shown) and side wall 46 each have a centrally positioned orifice 65 and a corner orifice 66 in the upper corner of side wall 44 and 46 nearest back wall 42.

Closure lid 41 is comprised of a top wall 67, a front wall 68 perpendicular to the top wall 67 and two side attachment members, only one shown at 70, each positioned perpendicularly on an end of top wall 67 at a point furthest from the front wall 68. Closure lid 41 is pivotably attached to frame member 40 as shown in FIG. 10, by the use of a pivot pin, extending through attachment members, only one shown at 70, and corner orifices 66 on side walls 44 and 46.

Extending perpendicularly out of front wall 68 is arm member 76 having a top surface 78, a bottom surface 80 and a face surface 82. Face surface 82 is formed with an orifice 84, and top surface 78 is formed with a notch 86. Arm member 76 is positioned on front wall 68 to cooperatively engage eyeclip or tab 29 located on the bottom storage area 14.

In operation, when storage area 14 is fully zipped up, zipper 26 is inserted on arm member 76 in notch 86. The storage area 14 is then folded wherein arm member 76 is inserted into longitudinal slit 31 on eyeclip on tab 29. A lock can then be inserted in orifice 84 on arm member 76 to insure protection of the garments stored in storage area 14 or a self contained locking zipper can be used.

Front wall 68 is further provided with two inwardly angularly displaced shoulder members 88 and 90 respectively. Shoulder members 88 and 90 are formed by cutting slits 92 and 94 in front wall 68 forming two front end wall members, 96 and 98 respectively, having bottom portions 100 and 102 respectively. The bottom portions 100 and 102 are then bent inwardly to form shoulder members 88 and 90. As shown in FIGS. 10 and 11 when closure lid 41 is pivoted downwardly shoulder members 88 and 90 engage front flanges 48 and 50 to provide a locking fit.

Figure 12:
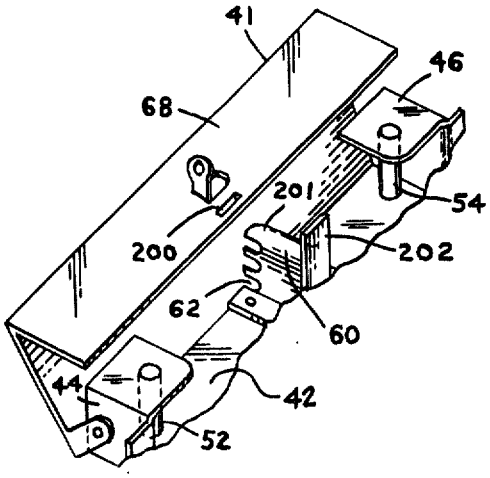
FIG. 12 is a cutaway view of another embodiment of the closure assembly.

Now referring to FIG. 12, there is shown an alternate embodiment of closing closure member 36. Rather than cutting two displaced shoulder members into front wall 68 of closure member 36, there is formed a horizontal slit 200 below arm member 76. As in the previous embodiment, there is mounted on the inside of back wall 42 and extending outwardly therefrom hangar support 60. Hangar support 60 has at least three notches 62, 63 and 64, a front end 201, and a lip member 202 on the bottom of the front end 201. To close closure member 36, closure lid 41 is pressed down such that lip member 202 engages horizontal slit 200 on front wall 68. To open front wall 68 is lifted up such that lip member 202 is disengaged from horizontal slit 200.

Attachment member 38 is of one or two piece construction having two wing members, 104 and 106 respectively and a connecting member 108. Wing members 104 and 106 each have two orifices 10 perpherally located and two orifices 111 interior thereto positioned to engage end flanges 56 and 58 respectively. The connecting member 108 is a narrow strip such that when the closure member 36 is connected to the attachment member 38, connecting member 108 does not interfere with the hanging of the garments. Attachment member 38 is inserted within storage area 14 and abuts against the interior of side panel that is within the closest proximity of zipper 26.

Now referring to FIG. 5, attachment member 38 is affixed to side panel 20 by locking 112 pins being inserted in peripherally located orifices 110 in wing members 104 and 106 and extending through side panel 20. Although attachment member 38 is shown to be of abbreviated length, attachment member 38 can extend over the total length of the top of storage area 14.

Closure member 36 is affixed to storage area 14 and attachment member 38 by locking pins 114 inserted within orifices 59 in end flanges 56 and 58 of closure member 36 through side panel 20 and within orifices 111 in wing members 104 and 106.

Handle member 34 is comprised of a handle 116, an intermediate slot 118 through the center of handle 116, hook 120 pivotably mounted within longitudinal slot 118 and a pair of attachment pins 122 located at the base of handle 116 for affixing handle member 34 to closure member 36. Attachment pins 122 are friction fitted in centrally positioned orifices 65 in side wall 44 and 46 to mount handle 116.

As previously stated hook 120 is pivotably mounted within longitudinal slot 118, whereby when not used it can be positioned within the longitudinal slot as shown in FIG. 5. The hook 120 has an exterior surface 124 and an interior surface 126. Located on exterior surface 124 is knob 128 which assists in removing the hook 120 from longitudinal slot 118. Located on the interior surface 126 of the hook 120 is notched surface 130 which engages a hanging rail (not shown) when the hook 120 is used to hang up the garment bag 10. Hook 120 can be tapered so as to provide a tight fit in longitudinal slit 118 by forcing slit 118 to open.

Numerous modifications and variations of the above disclosed invention are possible in light of the above teachings and, therefore, within the scope of the appended claims the invention may be practiced otherwise than as particularly described.

What is claimed is:

1. A novel garment bag for hanging items therein, comprising:

a storage area formed by a front panel, a back panel and a side gusset;

a means for opening and closing said storage area positioned on said front panel;

a handle assembly positionable at a terminus of said means for opening and closing said storage area on said side gusset of said storage area, said handle assembly comprised of a handle member, a hanging member, a closure member and a means for attaching said handle assembly to said gusset of said storage area.

2. The novel garment bag as defined in claim 1 wherein said means for opening and closing said storage area on said front panel is a zipper and a pull tab for closing said zipper, said pull tab having an orifice therein.

3. The novel garment bag as defined in claim 2 and further comprising a plurality of pairs of fastener members positionable in opposite corners on said front panel for securing the storage area when folded upon itself.

4. The novel garment bag as defined in claim 1 wherein said closure member of said handle assembly is formed of a frame member and a closure lid pivotably positioned on said frame member, said frame member having a back wall, a pair of side walls, a pair of front flanges, a pair of support pins positioned between said pair of front flanges and said back wall and a pair of end flanges positioned perpendicularly to the bottom of said end walls, said end flanges each having a pair of orifices, said closure lid having a top wall, a front wall perpendicular to said top wall, and a pair of attachment members, each positioned perpendicularly on an end of said top wall at a point furthest from said side walls, said attachment members pivotably attached to said frame member on said side walls.

5. The novel garment bag as defined in claim 4 wherein mounted within said frame member on said back wall and extending outwardly therefrom is a hanger support, said hanger support having at least two notches for positioning a hanger thereon.

6. The novel garment bag as defined in claim 5 wherein said front wall perpendicular to said top wall of said closure lid is provided with a means for securing said closure lid to said frame member.

7. The novel garment bag as defined in claim 6 wherein said means for securing said closure lid to said frame member is comprised of a pair of inwardly angularly displaced shoulder members each disposed on a side end of said front wall of said closure lid and engageable with said front flanges of said frame member when said closure lid is pivoted downwardly.

8. The novel garment bag as defined in claim 6 wherein said means for securing said closure lid to said frame member is comprised of a horizontal slit centrally positioned on said front wall of said closure lid and a lip member disposed on said hanger support positioned to be inserted in said horizontal slit of said front wall when said closure lid is pivoted downwardly.

9. The novel garment bag as defined in claim 1 wherein said handle member is comprised of a handle pivotably mounted on said closure member, a longitudinal slot through said handle member and a hook pivotably mounted to said handle and disposable within said longitudinal slot.

10. The novel garment bag as defined in claim 2 and further comprising a tab disposed within said storage area and extending out of said front panel at a terminus of said zipper opposite said handle assembly, said tab being formed with a slit, and an arm member extending from said front wall of said closure lid, said arm member having an orifice, said arm member is positioned on said front of said closure lid to cooperatively be inserted within said slit on said tab when said garment bag is folded upon itself.

11. The novel garment bag as defined in claim 10 wherein said arm member on said front wall of said closure lid is inserted within said orifice of said tab at said terminus of said zipper and secured by a locking member.

* * * * *